US010602773B2

(12) United States Patent
Biel et al.

(10) Patent No.: US 10,602,773 B2
(45) Date of Patent: Mar. 31, 2020

(54) MOUTH PIECE OF AN ELECTRONIC SMOKING DEVICE HAVING A TEMPERING ELEMENT

(71) Applicant: Fontem Holdings 1 B.V., Amsterdam (DE)

(72) Inventors: Stefan Biel, Hamburg (DE); Vaclav Borkovec, Hamburg (DE); Emin Yener, Hamburg (DE); Liliana Maria Ferreira Chaves, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 81 days.

(21) Appl. No.: 15/576,663

(22) PCT Filed: May 26, 2016

(86) PCT No.: PCT/EP2016/061902
§ 371 (c)(1),
(2) Date: Nov. 22, 2017

(87) PCT Pub. No.: WO2016/189086
PCT Pub. Date: Dec. 1, 2016

(65) Prior Publication Data

US 2018/0132523 A1 May 17, 2018

(30) Foreign Application Priority Data

May 26, 2015 (EP) ..... 15169205

(51) Int. Cl.
*A24F 13/00* (2006.01)
*A24F 17/00* (2006.01)
(Continued)

(52) U.S. Cl.
CPC ..... *A24F 7/04* (2013.01); *A24F 47/008* (2013.01); *H05B 3/44* (2013.01)

(58) Field of Classification Search
CPC ..... A24F 47/008; A24F 47/002
(Continued)

(56) References Cited

U.S. PATENT DOCUMENTS 5,878,752 A 3/1999 Adams et al.
9,301,547 B2 * 4/2016 Liu ..... A24F 47/008
(Continued)

FOREIGN PATENT DOCUMENTS

CN 1209731 A 3/1999
CN 203168035 U 9/2013
(Continued)

OTHER PUBLICATIONS

European Search Report, dated Mar. 23, 2016, 11 pages, European Patent Office.

(Continued)

*Primary Examiner* — Hae Moon Hyeon
(74) *Attorney, Agent, or Firm* — Dykema Gossett PLLC

(57) ABSTRACT

The present invention relates generally to electronic smoking devices and in particular electronic cigarettes. A mouthpiece for an electronic smoking device has an elongated housing having ports at opposite ends; a central passage formed as a hollow channel through the housing in communication with the ports, contact terminals for connecting to a battery of the electronic smoking device and conductive elements connected to the contact terminals, the conductive elements being configured for connecting, to the battery, an tempering element for tempering an aerosol produced by the electronic smoking device. Using the tempering element, aerosol passing through the central passage can be tempered and loss of aerosol due to condensation is reduced.

19 Claims, 3 Drawing Sheets

(51) Int. Cl.

| | |
|---|---|
| ***A24F 25/00*** | (2006.01) |
| ***A24F 7/04*** | (2006.01) |
| ***A24F 47/00*** | (2020.01) |
| ***H05B 3/44*** | (2006.01) |

(58) Field of Classification Search
USPC ..... 131/329, 328
See application file for complete search history.

(56) References Cited

U.S. PATENT DOCUMENTS

| | | | | |
|---|---|---|---|---|
| 2012/0260927 | A1* | 10/2012 | Liu | A24F 47/008 131/329 |
| 2013/0192615 | A1 | 8/2013 | Tucker et al. | |
| 2014/0338680 | A1 | 11/2014 | Abramov et al. | |
| 2014/0366898 | A1* | 12/2014 | Monsees | A24F 47/008 131/329 |
| 2015/0181937 | A1* | 7/2015 | Dubief | A24F 47/008 131/329 |
| 2015/0196059 | A1* | 7/2015 | Liu | H05B 3/06 131/329 |
| 2016/0135505 | A1* | 5/2016 | Li | H05B 3/44 131/329 |
| 2016/0331033 | A1* | 11/2016 | Hopps | A24F 47/008 |
| 2017/0347706 | A1* | 12/2017 | Aoun | F22B 1/284 |
| 2018/0103685 | A1* | 4/2018 | Yener | A24F 47/008 |
| 2018/0168227 | A1* | 6/2018 | Fraser | A24F 47/008 |
| 2018/0338531 | A1* | 11/2018 | Reevell | A24F 47/008 |

FOREIGN PATENT DOCUMENTS

| | | | |
|---|---|---|---|
| CN | 103763954 | A | 4/2014 |
| CN | 203 646 511 | U | 6/2014 |
| CN | 203 748 667 | U | 8/2014 |
| CN | 204317498 | U | 5/2015 |

OTHER PUBLICATIONS

Combined Search and Examination Report under Sections 17 and 18(3), dated Aug. 24, 2015, 7 pages, United Kingdom Intellectual Property Office.

Fuoco et al., "Influential parameters on particle concentration and size distribution in the mainstream of e-cigarettes", Environmental Pollution, 184:523-529 (Jan. 2014).

* cited by examiner

MOUTH PIECE OF AN ELECTRONIC SMOKING DEVICE HAVING A TEMPERING ELEMENT

CROSS-REFERENCE TO RELATED APPLICATIONS

This application is a national stage filing based upon international application no. PCT/EP2016/061902, filed 26 May 2016 and published in English on 1 Dec. 2016 under international publication No. W02016/189086 (the '086 application), which claims priority to European application No. 15169205.0, filed 26 May 2015 (the '205 application). The '086 application and the '205 application are both hereby incorporated by reference as though fully set forth herein.

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

In some electronic smoking devices the vaporized or atomized liquid is provided as aerosol in a central passage between the atomizer to an air inhalation port where the user puffs on the device thereby generating the flow of gas.

SUMMARY OF THE INVENTION

In accordance with one aspect of the present invention there is provided a mouthpiece for an electronic smoking device and an electronic smoking device comprising the mouthpiece.

In one aspect the mouthpiece comprises an elongated housing having ports at opposite ends and a central passage formed as a hollow channel through the housing in communication with the ports. The mouthpiece further comprises contact terminals for connecting to a battery of the electronic smoking device and conductive elements connected to the contact terminals, the electric conductive elements being configured for connecting, to the battery, a tempering element for tempering an aerosol produced by the electronic smoking device.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Figure 1:
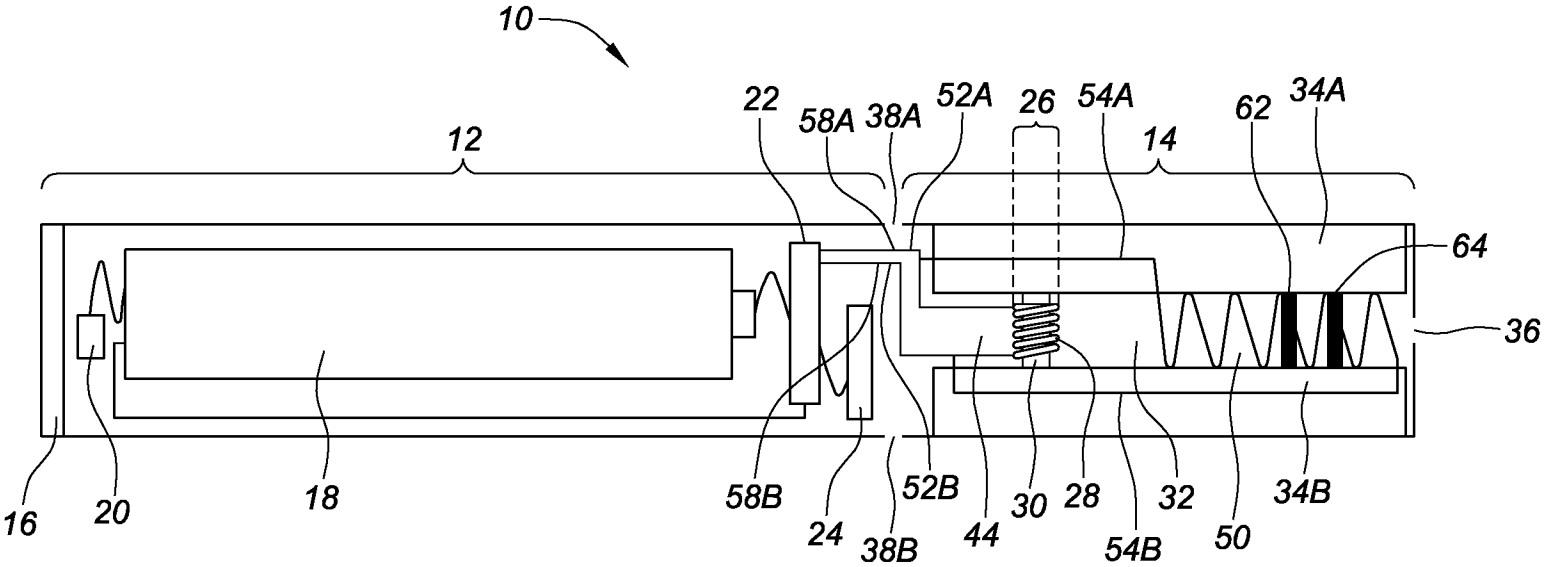
FIG. 1 is a schematic cross-sectional illustration of an exemplary e-cigarette having a mouthpiece according to an embodiment.

Throughout the following, an electronic smoking device will be exemplarily described with reference to an e-cigarette. As is shown in FIG. 1, an e-cigarette 10 typically has an elongated housing comprising a cylindrical hollow tube having an end cap 16. The cylindrical hollow tube may be a single piece or a multiple piece tube. In FIG. 1, the cylindrical hollow tube is shown as a two piece structure having a battery portion 12 and an atomizer/liquid reservoir portion 14. Together the battery portion 12 and the atomizer/liquid reservoir portion 14 form a cylindrical tube which is approximately the same size and shape as a conventional cigarette, typically about 100 mm with a 7.5 mm diameter, although lengths may range from 70 to 150 or 180 mm, and diameters from 5 to 20 mm.

The battery portion 12 and atomizer/liquid reservoir portion 14 are typically made of steel or hardwearing plastic and act together with the end cap 16 to provide a housing to contain the components of the e-cigarette 10. The battery portion 12 and an atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow a light emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 1 shows a pair of air inlets 38 provided at the intersection between the battery portion 12 and the atomizer/liquid reservoir portion 14.

A battery 18, a light emitting diode (LED) 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the light emitting diode (LED) 20 is at the front end of the battery portion 12, adjacent to the end cap 16 and the control electronics 22 and airflow sensor 24 are provided in the central cavity at the other end of the battery portion 12 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14, the central passage being in communication with ports at opposite ends of an elongated housing of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of tempering elements, such as ceramic heaters, or fiber or mesh material heaters. Nonresistance tempering elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

One of the ports is provided at an end of the housing for being fitted together with the battery portion 12. The other port is an air inhalation port 36 provided at the back end of the atomizer/liquid reservoir portion 14 remote from the end cap 16. The air inhalation port 36 may be formed from the cylindrical hollow tube atomizer/liquid reservoir portion 14 or may be formed in an end cap.

In use, a user sucks on the e-cigarette 10. This causes air to be drawn into the e-cigarette 10 via one or more air inlets, such as air inlets 38 and to be drawn through the central passage 32 towards the air inhalation port 36. The change in air pressure which arises is detected by the airflow sensor 24 which generates an electrical signal that is passed to the control electronics 22. In response to the signal, the control electronics 22 activate the heating coil 28 which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarettes are intended to be disposable and the electric power in the battery 18 is intended to be sufficient to vaporize the liquid contained within the liquid reservoir 34 after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent to the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

In the embodiment of a mouthpiece portion depicted in FIG. 1, the mouthpiece portion is a atomizer/liquid reservoir portion 14 which further comprises a tempering element 50 connected to conductive elements 54A, B which are further connected to contact terminals 52A, B. In the embodiment depicted in FIG. 1, the tempering element 50 includes a tempering coil arranged in the central passage 32. The contact terminals 52A B arranged adjacent to an attachment port 44 of two ports connected by the central passage 32, the other port of two ports serving as an air inhalation port 36.

Using the contact terminals 52A, B which contact counter contact terminals 58A, B of the battery portion which are connected to the control electronics 22, the tempering element 50 is connected to the control electronics 22 in parallel to the atomizer 26. Through tempering, condensation of the aerosol is prevented or reduced compared to a central passage in which no tempering is provided. The tempering may be such that a temperature drop within the tempered section is avoided or reduced. The tempering may be such that a temperature increase occurs in the tempered section. A temperature of the tempering element when operated may be lower than a threshold temperature at or above which droplets of the aerosol evaporates. Particularly, when operated the tempering element and the heating coil of the atomizer may have significantly different temperatures.

In embodiments of electronic cigarettes where battery portion and atomizer/liquid reservoir portion are formed as a single piece or where battery portion and atomizer/liquid reservoir portion cannot be separated once fitted together the contact counter contact terminals 58A, B of the battery portion may be formed integrally with the control electronics 22 or with the conductive elements 54A, B. Then, the conductive elements 54A, B extend from the control electronics 22 to the tempering element 50.

In the example shown, the tempering element 50 is a coil is wrapped around the central passage 32. Other tempering elements may be used. The tempering element 50 may be positioned between in the atomizer 26 and the air inhalation port 36 and may be transverse or parallel to the liquid reservoir 34. The tempering element 50 does not completely block the central passage 32. Rather an air gap is provided on either side of the tempering element 50 enabling air to flow past the tempering element 50.

In the example shown in FIG. 1 there are further provided a catalytic converter 62 and a filter 64 in the section of the central passage 32 surrounded by the tempering element 50. However presence of one or both of the catalytic converter 62 and the filter 64 is optional.

Figure 2:
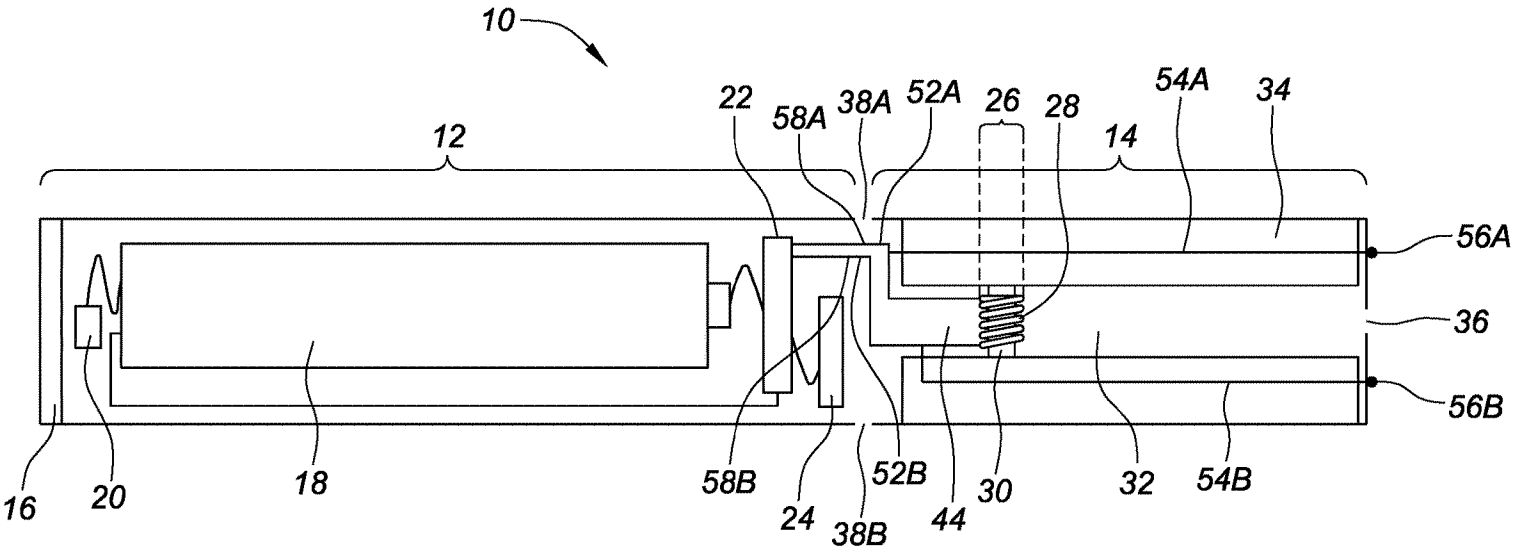
FIG. 2 is a schematic cross-sectional illustration of a an exemplary e-cigarette having a mouthpiece according to another embodiment.

In a further embodiment of a mouthpiece portion depicted in FIG. 2, the mouthpiece portion is an atomizer/liquid reservoir portion 14 which further comprises conductive elements 54A, B which are connected to contact terminals 52A, B and which further are connected to further contact terminals 56A, B. Using the conductive elements 54A, B and the contact terminals 52A, B which contact counter contact terminals 58A, B of the battery portion 12 which are connected to the control electronics 22, the further contact terminals 56A, B are connected to the control electronics 22 such that a tempering element can be connected in parallel to the atomizer 26 using the further contact terminals 56A, B.

In embodiments of electronic cigarettes where battery portion and atomizer/liquid reservoir portion are formed as a single piece or where battery portion and atomizer/liquid reservoir portion cannot be separated once fitted together the contact counter contact terminals 58A, B of the battery portion may be formed integrally with the control electronics 22 or with the conductive elements 54A, B. Then, the conductive elements 54A, B extend from the control electronics 22 to the further contact terminals 56A, B.

For instance, a further mouthpiece portion (or mouthpiece extension portion) 114 according to yet another embodiment can be connected to the control electronics 22 using the further contact terminals. In this further embodiment, the air inhalation port 36 of the atomizer/liquid reservoir portion 14 acts as an aerosol provision port.

Figure 3:
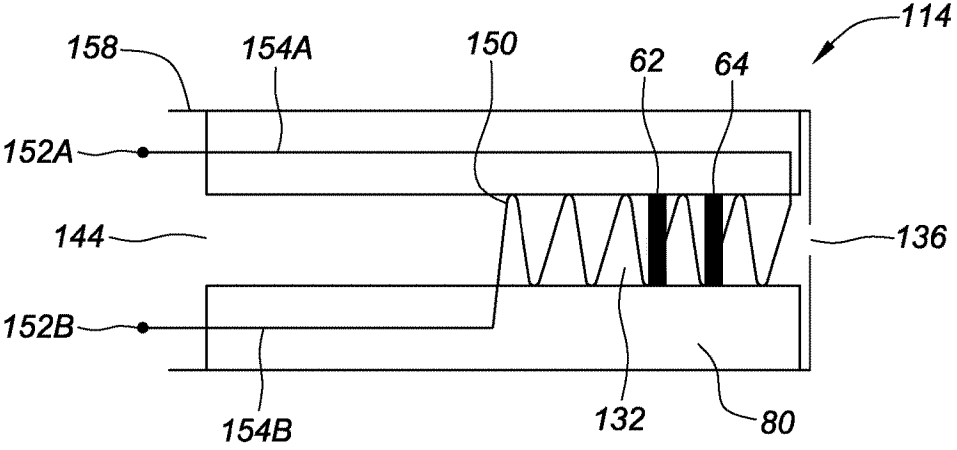
FIG. 3 is a schematic cross-sectional illustration of a mouthpiece according to yet another embodiment.

In the example of yet a further mouthpiece 114 shown in FIG. 3, the tempering element 50 is a coil arranged in a central passage 132 of the further mouthpiece 114. The central passage 132 of the further mouthpiece 114 extends from an attachment port 144 of two ports of the further mouthpiece 114 to an air inhalation port 136 of said two ports of the further mouthpiece 114. The tempering element 50 is connected to via conductive elements 154A, B to contact terminals 152A, B arranged in an area surrounding the attachment port 144. The central passage 132 of the further mouthpiece 114 hence provides an extension of the central passage 32 of the mouthpiece 14.

The coil 150 surrounds the central passage 132 in the further mouthpiece 114. In the embodiment depicted it is surrounded by a further element 80. The further element 80 is optional. As well, the further element 80 may be surrounded by the tempering element 50. If present the further element 80 can be one of: a liquid reservoir, a powder reservoir or an isolating element.

When being attached to the mouthpiece of FIG. 2 the contact terminals 152A B of the further mouthpiece 114 are in electrical contact with the further contact terminals 56A, B of the mouthpiece 14. The further contact terminals 56A, B are connectable to a battery 18 wherein control electronics 22 control the connection.

When connected to the battery, the tempering element 50 hence is operable to temper the aerosol provided through the attachment port 144 into the central passage 132 of the further mouthpiece 114. Through tempering, condensation of the aerosol is prevented or reduced compared to a central passage 132 in which no tempering is provided. The tempering may be such that a temperature drop within the tempered section is avoided or reduced. The tempering may be such that a temperature increase occurs in the tempered section. A temperature of the tempering element when operated may be lower than a threshold temperature at or above which condensate of the aerosol evaporates. Particularly, when operated the tempering element and the heating coil of the atomizer may have significantly different temperatures.

Figure 4:
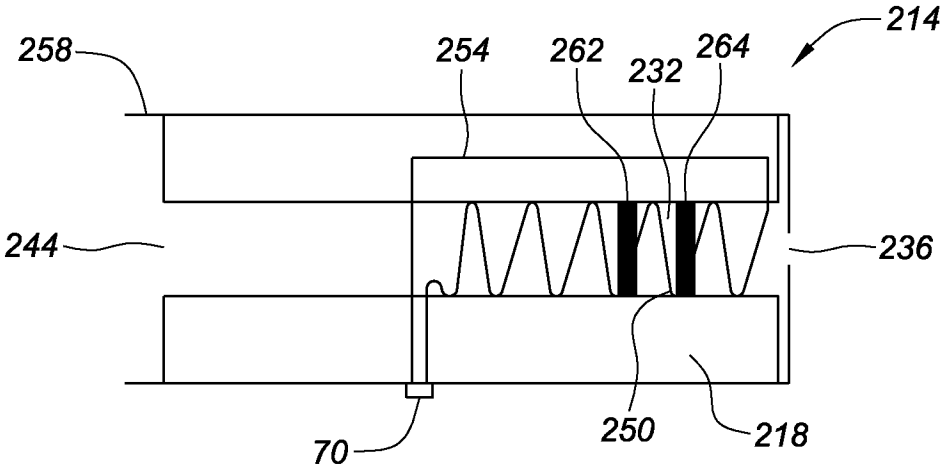
FIG. 4 is a schematic cross-sectional illustration of a mouthpiece according to even yet another embodiment.

FIG. 4 shows even yet another example of the mouthpiece 214 in more detail. The tempering element is a coil 250 connected to a further battery 218 of the further mouthpiece 218. The mouthpiece 214 comprises an input element 70 for a user to activate the tempering element 250 by an input. The input element 70 may a push button. The input element 70 is optional.

When connected to the battery, the tempering element 250 hence is operable to temper the aerosol provided through the attachment port 244 into the central passage 232 of the further mouthpiece 214. Through tempering, condensation of the aerosol is prevented or reduced compared to a central passage in which no tempering is provided. The tempering may be such that a temperature drop within the tempered section is avoided or reduced. The tempering may be such that a temperature increase occurs in the tempered section. A temperature of the tempering element, when operated, may be lower than a threshold temperature at or above which condensate of the aerosol evaporates. Particularly, when operated the tempering element and the heating coil of the atomizer may have significantly different temperatures.

In the examples shown in FIGS. 3 and 4 there are further provided a respective catalytic converter 62, 262 and respective a filter 64, 264 in the section of the central passage 132, 232 surrounded by the tempering element 150, 250. However presence of one or both of the catalytic converter 62, 262 and the filter 64, 264 is optional in both examples.

A mouthpiece according to an embodiment for an electronic smoking device comprises an elongated housing having ports at opposite ends, a central passage formed as a hollow channel through the housing in communication with the ports, contact terminals for connecting to a battery of the electronic smoking device and conductive elements connected to the contact terminals, the electric conductive elements being configured for connecting, to the battery, an tempering element for tempering an aerosol produced by the electronic smoking device.

The mouthpiece can be an atomizer/liquid reservoir portion of an electronic smoking device, wherein the contact terminals are arranged at one of the ports, the atomizer/liquid reservoir portion further comprising an atomizer arranged in the central passage operable when connected to the battery for the electronic smoking device to atomize liquid stored in a liquid reservoir such that the aerosol is provided in the central passage.

The mouthpiece may further comprise the tempering element arranged in the central passage and connected to the conductive elements. The tempering element may extend from the other port at least along a section of the central passage. The tempering element may surround the section of the central passage. The tempering element may surround a further element surrounding the section of the central passage. The mouthpiece may further comprise the liquid reservoir. The mouthpiece may further comprise further contact terminals arranged at the other of the ports for connecting the tempering element. The mouthpiece may further comprise a filter arranged in the central passage.

The mouthpiece may further comprise a catalytic converter arranged in the central passage. The tempering element may be operable when connected to the battery to temper the aerosol such condensation of the aerosol is prevented or reduced. The one port may be configured for attachment to a further mouthpiece having the other port correspondingly configured wherein, by the attachment, the contact terminals get in contact with the further contact terminals of the further mouthpiece. At least one coupling element 158, 258 for releasable attachment of the attachment port to the other port of the further mouthpiece may be comprised by the mouthpiece.

The mouthpiece may further comprise the battery wherein the one port is configured for attachment to an aerosol provision port at one end of a further housing of an atomizer/liquid reservoir portion further comprising a further central passage through the further housing, a liquid reservoir, and an atomizer operable when connected to a further battery for the electronic smoking device to atomize liquid stored in the liquid reservoir such that the aerosol is provided into the central passage from the further central passage through the aerosol provision port and the one port.

In an exemplary embodiment an electronic smocking device comprises the mouthpiece. In one embodiment, the tempering element may be operated while the atomizer is operated. The tempering element may be operated only while the atomizer is operated. Or, operation of the tempering element may be continued for a predetermined time after operation of the atomizer is terminated. In one embodiment, the tempering element may be operated if the atomizer is operated and an additional condition is met. The additional condition may be a temperature measured in the central passage not exceeding a threshold temperature or a user input such as pushing of a button. Or, the tempering element may be operated in response to the user input, independent from whether the atomizer is operated.

An embodiment of an electronic cigarette comprises a tempering element tempering an aerosol produced by the electronic smoking device.

Using the tempering element, aerosol passing from the atomizer to the air inhalation port can be tempered and loss of aerosol due to condensation is reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 electronic smoking device
12 battery portion
14, 114 mouthpiece
16 end cap
18, 118 battery
20 light emitting diode (LED)
22 control electronics
24 airflow sensor
26 atomizer
28 heating coil
30 wick
32, 132 central passage
34, 134 liquid reservoir
36, 136 air inhalation port/aerosol provision port
38 air inlets
44, 144 attachment port
50, 150 tempering element
52A, B, 152A, B contact terminals
54A, B 154A, B conductive elements
56A, B further contact terminals
58A, B counter contact terminals
62 filter
64 catalytic converter
70 input element
80 further element

The invention claimed is:

1. A mouthpiece for an electronic smoking device, the mouthpiece comprising:

an elongated housing having an attachment port at a first end and an inhalation port at an opposing second end;

a central passage formed as a hollow channel through the housing, the central passage in communication with the attachment port and the inhalation port;

contact terminals for connecting to a battery of the electronic smoking device;

conductive elements connected to the contact terminals, the conductive elements being configured for connecting, to the battery; and a tempering element electrically connected to the conductive element and located along the central passage, the tempering element for heating the air in the central passage, and wherein tempering element is configured to operate below a temperature at which the aerosol evaporates.

2. The mouthpiece of claim 1 wherein the mouthpiece is an atomizer/liquid reservoir portion of the electronic smoking device and the contact terminals are arranged at the attachment port, the atomizer/liquid reservoir portion further comprising:

a liquid reservoir located within the elongated housing and communicatively coupled with the central passage; and an atomizer arranged in the central passage operable when connected to the battery for the electronic smoking device to atomize liquid stored in a liquid reservoir such that the aerosol is provided in the central passage.

3. The mouthpiece of claim 2 further comprising the liquid reservoir.

4. The mouthpiece of claim 2 further comprising:

a second mouthpiece configured for attachment to the mouthpiece, the second mouthpiece including:

a second housing including a second attachment port at a first end and a second inhalation port at a second end;

a second central passage formed as a hollow channel through the second housing, the second central passage in communication with the second attachment port and the second inhalation port, the second central passage is adapted to receive the aerosol from the central passage through the second attachment port;

a coupling element configured for releasably attaching the inhalation port to the second attachment port of the second mouthpiece; and a second battery within the second housing, the second battery electrically coupled to a second tempering element using a plurality of coupling elements, the second tempering element adapted to heat air in the second central passage to reduce condensation of the aerosol.

5. The mouthpiece of claim 1 wherein the tempering element is arranged in the central passage and connected to the conductive elements.

6. The mouthpiece of claim 5 wherein the tempering element extends from the inhalation port at least along a section of the central passage.

7. The mouthpiece of claim 6 wherein the tempering element is arranged around the hollow channel of the section of the central passage.

8. The mouthpiece of claim 6 wherein the tempering element surrounds a further element surrounding the section of the central passage.

9. The mouthpiece of claim 1 wherein the mouthpiece further comprises further contact terminals arranged at the inhalation port, the further contact terminals adapted for connecting the battery to the tempering element.

10. The mouthpiece of claim 9 wherein a further attachment port of a further mouthpiece is configured for attachment to the inhalation port of the mouthpiece, and wherein the further contact terminals are adapted to contact with the contact terminals.

11. The mouthpiece of claim 10 wherein the further mouthpiece includes a further central passage, and the tempering element is arranged in the further central passage and connected to the conductive elements.

12. The mouthpiece of claim 10, further comprising at least one coupling element configured for releasably attaching the inhalation port to the further attachment port of the further mouthpiece.

13. The mouthpiece of claim 1 wherein the mouthpiece further comprises a filter arranged in the central passage.

14. The mouthpiece of claim 1 wherein the mouthpiece further comprises a catalytic converter arranged in the central passage.

15. The mouthpiece of claim 1 wherein the tempering element is operable when connected to the battery to temper the aerosol such condensation of the aerosol is reduced.

16. An electronic smoking device comprising:

a battery portion including a battery and first contact terminals electrically coupled to the battery;

a mouthpiece adapted to attach to the battery portion, the mouthpiece including:

an elongated housing having an attachment port at a first end and an inhalation port at an opposing second end;

a central passage formed as a hollow channel through the housing in communication with the attachment port and the inhalation port;

a tempering element located in the central passage and adapted to heat air in the central passage to reduce condensation of an aerosol, wherein tempering element is configured to operate below a temperature at which the aerosol evaporates;

second contact terminals coupled to the elongated housing and configured to connect to the first contact terminals; and conductive elements connected to the second contact terminals and the tempering element, the conductive elements configured for connecting the battery to the tempering element for heating the air in the central passage.

17. The electronic smoking device of claim 16 wherein the mouthpiece is an atomizer/liquid reservoir portion of the electronic smoking device and the second contact terminals are arranged at the attachment port, the atomizer/liquid reservoir portion further comprising:

an atomizer arranged in the central passage operable when connected to the battery for the electronic smoking device to atomize liquid stored in a liquid reservoir such that the aerosol is provided in the central passage.

18. The electronic smoking device of claim 16 wherein the tempering element extends from the inhalation port at least along a section of the central passage.

19. The electronic smoking device of claim 16 wherein in the tempering element surrounds the section of the central passage.

* * * * *